US008978612B2

(12) United States Patent
Nyberg

(10) Patent No.: US 8,978,612 B2
(45) Date of Patent: Mar. 17, 2015

(54) HIGH TEMPERATURE PISTON

(76) Inventor: Peter Nyberg, Borlänge (SE)

( * ) Notice: Subject to any disclaimer, the term of this patent is extended or adjusted under 35 U.S.C. 154(b) by 0 days.

(21) Appl. No.: 13/992,721

(22) PCT Filed: Nov. 10, 2011

(86) PCT No.: PCT/SE2011/051350

§ 371 (c)(1),
(2), (4) Date: Jul. 1, 2013

(87) PCT Pub. No.: WO2012/078093

PCT Pub. Date: Jun. 14, 2012

(65) Prior Publication Data

US 2013/0284141 A1 Oct. 31, 2013

(30) Foreign Application Priority Data

Dec. 9, 2010 (SE) ..... 1001176

(51) Int. Cl.

| | |
|---|---|
| ***F02F 3/00*** | (2006.01) |
| ***F02F 3/02*** | (2006.01) |
| ***F02F 3/10*** | (2006.01) |
| *F02B 3/06* | (2006.01) |
| *F02F 3/22* | (2006.01) |

(52) U.S. Cl.

CPC ..... *F02F 3/00* (2013.01); *F05C 2201/0448* (2013.01); *F02B 3/06* (2013.01); *F05C 2201/021* (2013.01); *F02F 3/22* (2013.01); *F02F 3/0069* (2013.01); *F02F 3/02* (2013.01); *F02F 3/105* (2013.01)

USPC ..... 123/193.6

(58) Field of Classification Search

CPC ..... F05C 2201/021; F05C 2201/0448; F02F 3/22; F02F 3/00; F02B 3/06

USPC ..... 123/193.6

See application file for complete search history.

(56) References Cited

U.S. PATENT DOCUMENTS

| | | | | |
|---|---|---|---|---|
| 3,805,677 | A | 4/1974 | Clary et al. | |
| 4,553,472 | A * | 11/1985 | Munro et al. | 92/176 |
| 5,261,238 | A * | 11/1993 | Olsen | 60/620 |
| 5,499,572 | A * | 3/1996 | Cobble | 92/212 |
| 7,383,808 | B1 | 6/2008 | Azevedo et al. | |
| 2008/0041333 | A1 * | 2/2008 | Jarrett et al. | 123/254 |
| 2008/0134879 | A1 | 6/2008 | Hofbauer | |

FOREIGN PATENT DOCUMENTS

| | | | |
|---|---|---|---|
| GB | 802480 | A | 10/1958 |

* cited by examiner

*Primary Examiner* — Lindsay Low
*Assistant Examiner* — Charles Brauch
(74) *Attorney, Agent, or Firm* — Capitol City TechLaw

(57) ABSTRACT

In a piston (1) for combustion engines are included a piston crown (2), a piston skirt (3) and portions (4A, 4B; 13) for receiving a piston pin (5) by means of which the piston is pivotally supported on a connection rod, whereby a protection (7) covering a major portion of a bottom side of the piston crown is supported on the piston pin. The protection is fitted in sealing engagement with a first inner portion of the piston skirt, forming an uninterrupted gap in relation to a main portion of the piston crown and with at least a portion of the protection being provided at a distance inside a second outer portion of the piston skirt.

11 Claims, 5 Drawing Sheets

A-A

B-B

HIGH TEMPERATURE PISTON

TECHNICAL FIELD

The invention generally concerns pistons for combustion engines and specifically relates to such a piston that is adapted for working at high temperatures.

BACKGROUND

The design of combustion chambers and pistons for combustion engines has in one respect focused primarily on reducing the load on the actual cylinder and the piston with associated piston rings, oil rings and piston pins moving therein. This has often been done by using different cooling arrangements for effectively leading off heat from said parts and thereby lowering the working temperature in them. The purpose thereof is to reduce the actual temperature load on the parts and also to reduce problems arising due to the different degree of heat expansion of the different relatively moving, cooperating parts, i.e. primarily between piston/piston rings and cylinder bore.

In a partly different respect efforts have been made to configure combustion engine combustion chambers and pistons so that combustion work may without negative consequences be performed at very high temperatures. The purpose thereof has been to increase engine efficiency by reducing heat losses and to improve combustion and thereby lower the fuel consumption and to a certain degree obtain a reduction of pollutions. Such elevated temperatures could as a consequence of heat expansion phenomena cause damage to the actual pistons and to their piston rings, usually in the form of gas sealing rings and oil scraper rings. In efforts to avoid these problems it has e.g. been suggested, in such connections, to provide a divided piston configuration, with a heat insulation gap between a piston crown portion being exposed to the highest temperatures and a piston skirt supporting the piston rings. By means of the gap between the piston parts and special seals provided therein it is possible to eliminate or at least subdue the effect of different heat expansion between the piston crown portion and its skirt portion. Often, different materials are also used for these parts, so that e.g. the piston crown portion is made of steel and the piston skirt of an aluminum alloy.

SUMMARY

A general object of the invention is thus to provide a combustion engine piston that eliminates or at least reduces the above discussed problems.

A more specific object of the invention is to provide an improved piston for combustion engines, being adapted for high working temperatures.

Another specific object of the invention is to provide a protection for a piston for combustion engines, which prevents coking of piston surfaces and oil channels.

These and other objects are met by the invention as defined by the accompanying claims.

The invention generally relates to pistons for combustion engines, having a piston crown, a piston skirt and a portion for accommodating a piston pin journaling the piston in a connecting rod. In order to obtain optimum conditions at the bottom side of the pistons and especially at oil channels for cooling piston rings, a basic idea of the invention is to employ a protection supported on the piston pin and covering a main portion of the bottom side of the piston crown. The protection sealingly engages an inner piston skirt portion. In assembled condition it forms a gap towards the piston crown and it is at least partly arranged inside an outer piston skirt portion. That makes it possible to avoid problems of oil burning onto the piston and thus of coking and clogging of oil channels.

In another aspect of the invention an appropriate protection is provided for a combustion engine piston. This protection is a hood having a dome shaped top portion, a cylindrical side wall and a rim formed integral with each other and having a piston pin journal, with the journal portion integrated in the side wall and consisting of apertures formed diametrically opposite each other in the side wall. By means of such a configuration a very advantageous and effective coking protection for such a piston is obtained in a very cost effective manner.

Further developments of the invention and embodiments thereof are stated in the subclaims.

Other advantages of the invention will be readily appreciated upon reading the below detailed description of embodiments of the invention.

BRIEF DESCRIPTION OF THE DRAWINGS

The invention and its further objects and advantages will be best understood by reference to the following description taken together with the accompanying drawings, in which.

DETAILED DESCRIPTION

Figure 1:
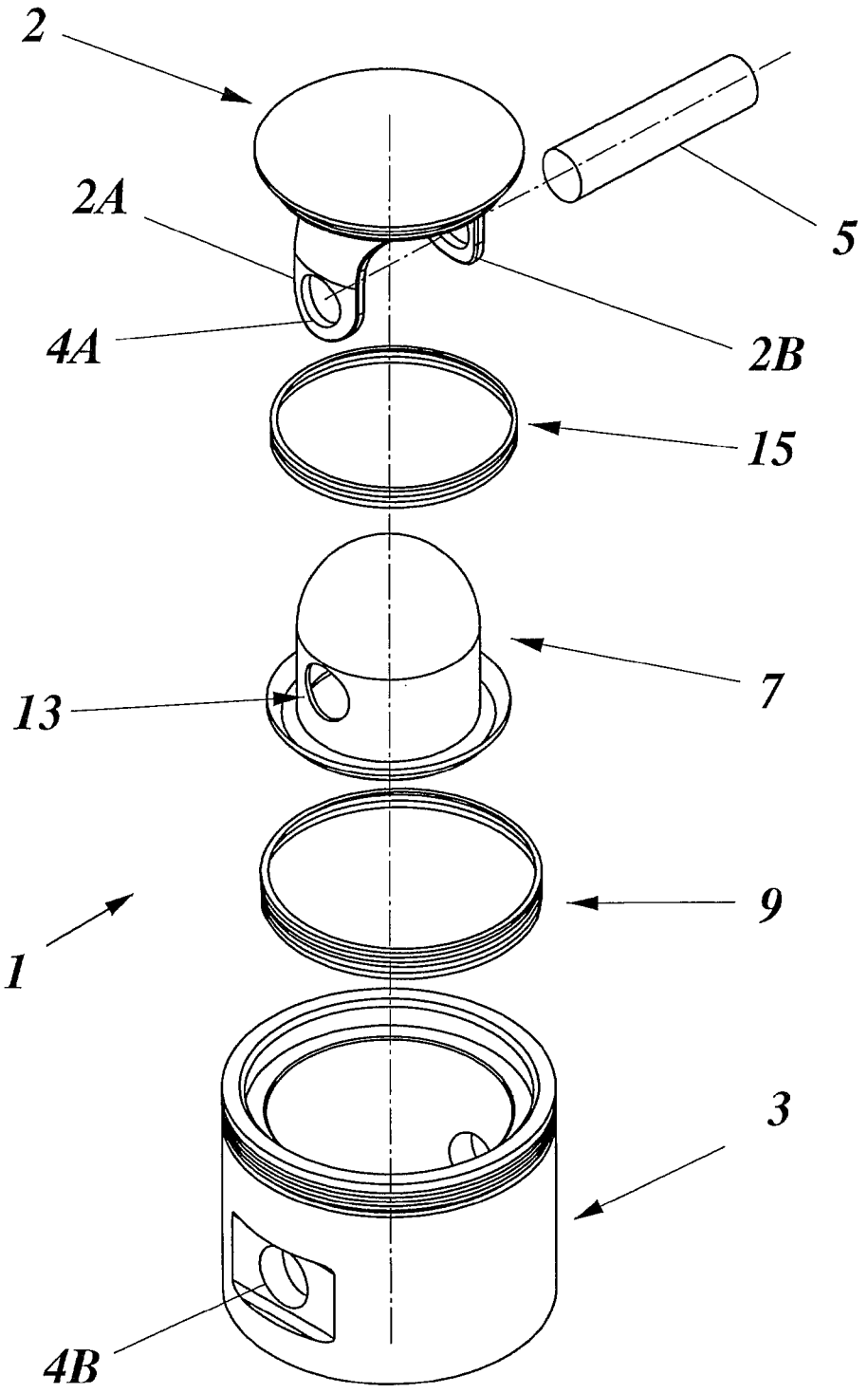
FIG. 1 is an exploded view of an embodiment of a piston according to the invention.

The principles of the invention will now be explained referring to an exemplary embodiment of the invention that is illustrated in the accompanying drawings. The embodiment of the invention that is illustrated in the drawings is an example of an application of the basic principles of the invention to a known type of piston for combustion engines. However, it shall be emphasized that the illustrated embodiment is given for the sole purpose of illustrating a presently preferred configuration of a piston according to the invention and is not intended to limit the invention to the details illustrated in the drawings.

Figure 2:
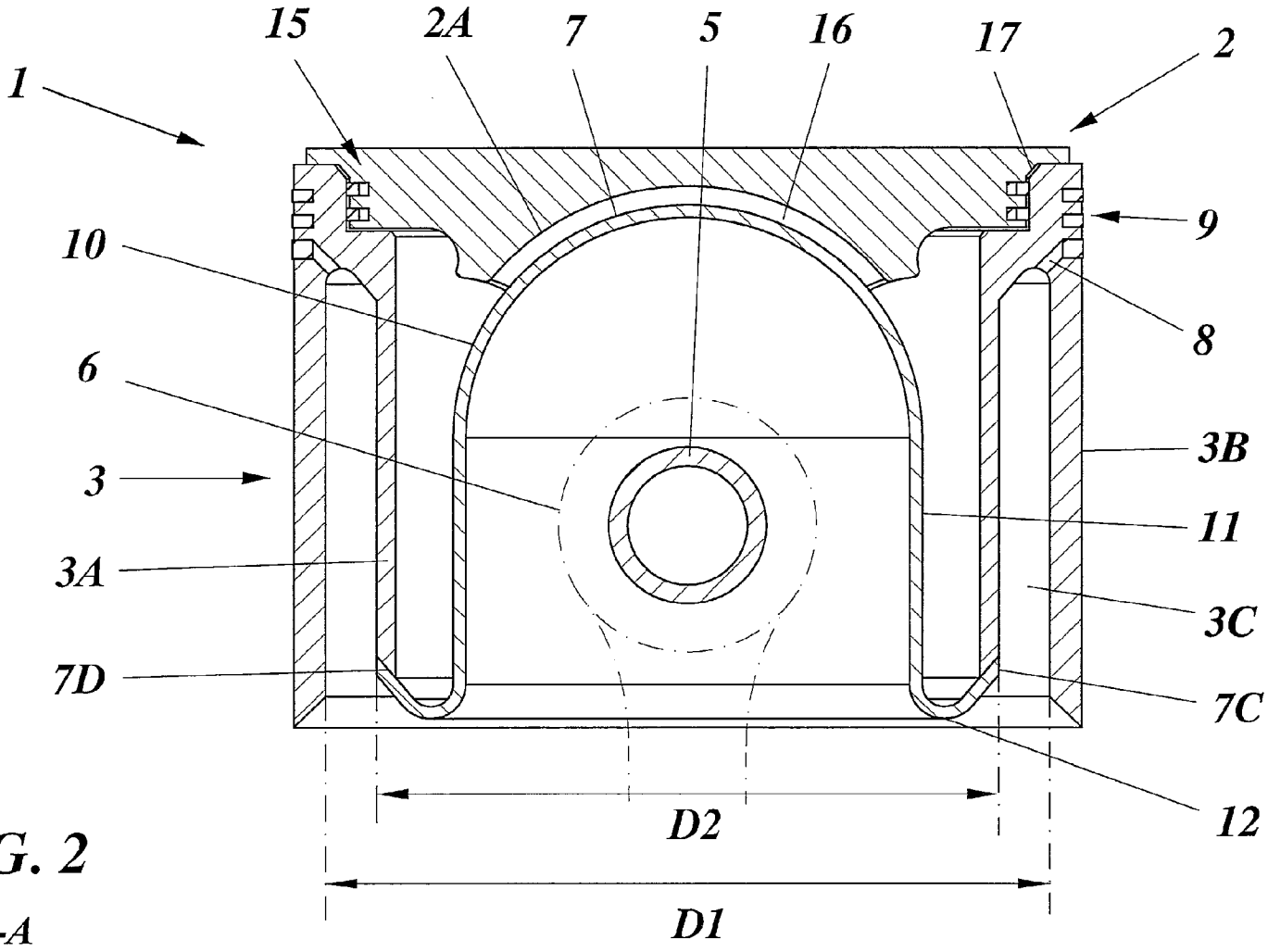
FIG. 2 is a longitudinal section, along a first plane A-A designated in FIG. 3, through the piston of the invention, as shown in FIG. 1.

As was mentioned above, the accompanying drawings illustrate a type of two-part piston 1 where the piston crown 2 and the piston skirt 3 consist of separate parts. The piston crown 2 and the piston skirt 3 both have journal portions 4A, 4B for being pivotally supported on a piston pin 5 that is only schematically illustrated in the drawings and that is in turn pivotally connected to a connecting rod 6 that is only indicated in FIG. 2. Such a piston is especially suitable for use in engines with higher working temperatures. This is partly due to the fact that it enables the use of different specifically adapted materials in the crown 2 that is subjected to the highest temperatures and in the skirt 3 that carries piston rings 9. A gap 17 between the different parts, which gap is sealed by means of appropriate seals 15, contributes further. In one example the different materials may consist of steel in the crown and aluminum in the skirt 3. The sealed gap 17 in turn secures that heat expansion in the piston crown 2 that is subjected to the highest temperatures is not transmitted to the piston skirt 3. This is important in order to avoid overloading the piston rings 9. By taking up temperature movements of the piston crown 2 in the gap 17 it is possible to prevent that the piston rings 9, which sealingly engage a non-illustrated cylinder wall of the engine, seizes up or jams against this cylinder wall.

Figure 3:
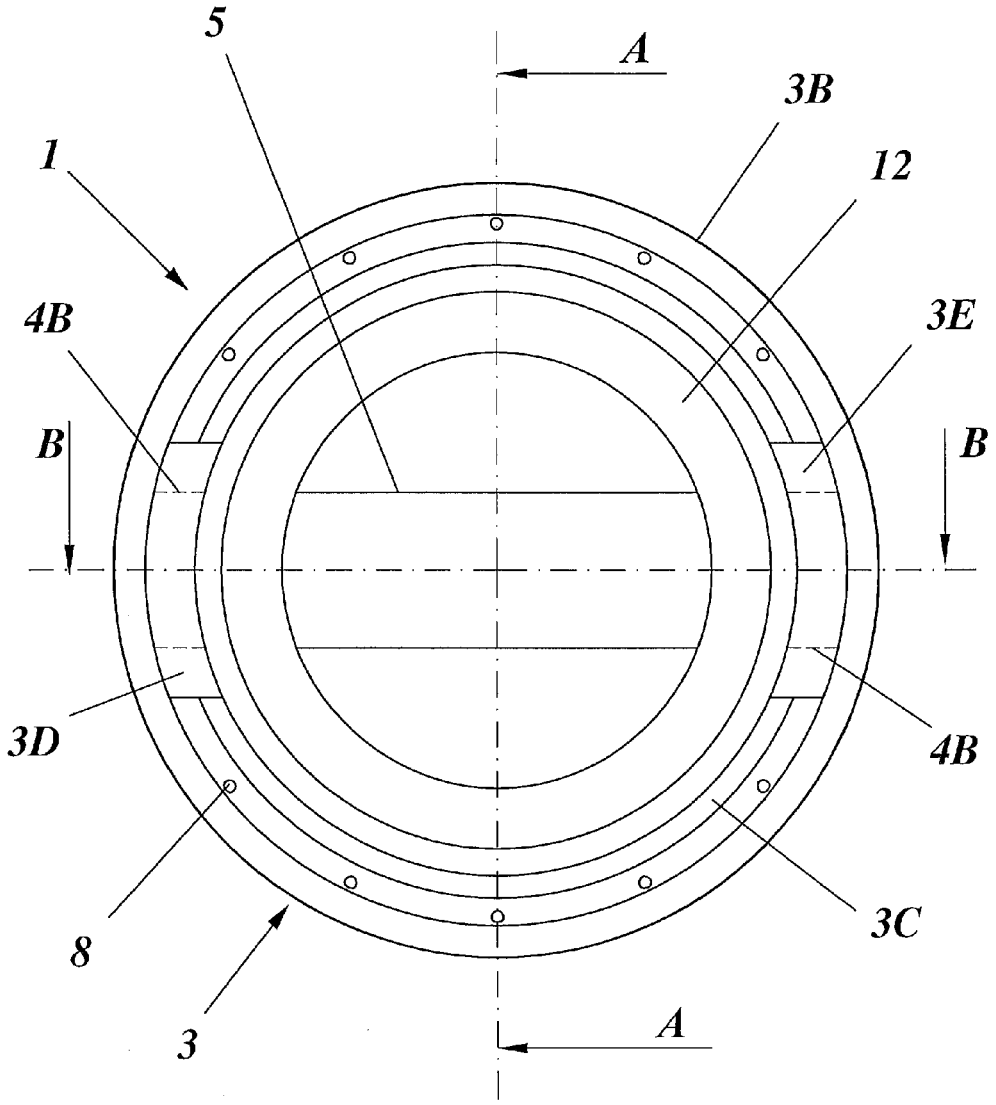
FIG. 3 is a plan view from below of the embodiment of a piston according to the invention that is shown in FIG. 1.

The piston skirt 3 has a general cylinder shape that is formed having a first inner portion 3A and a second outer portion 3B provided at a distance outside the first inner portion, said portions being joined together in diametrically opposite connection areas 3D, 3E (see FIG. 3). These connection areas 3D, 3E may extend over a restricted part of the circumference of the piston skirt 3 and over a restricted portion of the height of the piston skirt 3 or over its entire height. Through these connection areas 3D, 3E extends the piston pin 5 journal portion 4B that is formed as apertures provided diametrically opposite each other through the piston skirt 3 connection areas 3D, 3E. Expressed otherwise, an annular recess 3C opening downwardly and away from the piston crown 2, is formed between the first 3A and second 3B portion of the piston skirt 3. The recess 3C extends around the entire circumference of the piston skirt 3, except at the connection areas 3D, 3E. At its upper end the recess 3C communicates with a number of separated oil channels 8 for supplying oil to at least one (not specifically designated) oil lubricated oil ring among the piston rings 9.

Figure 4:
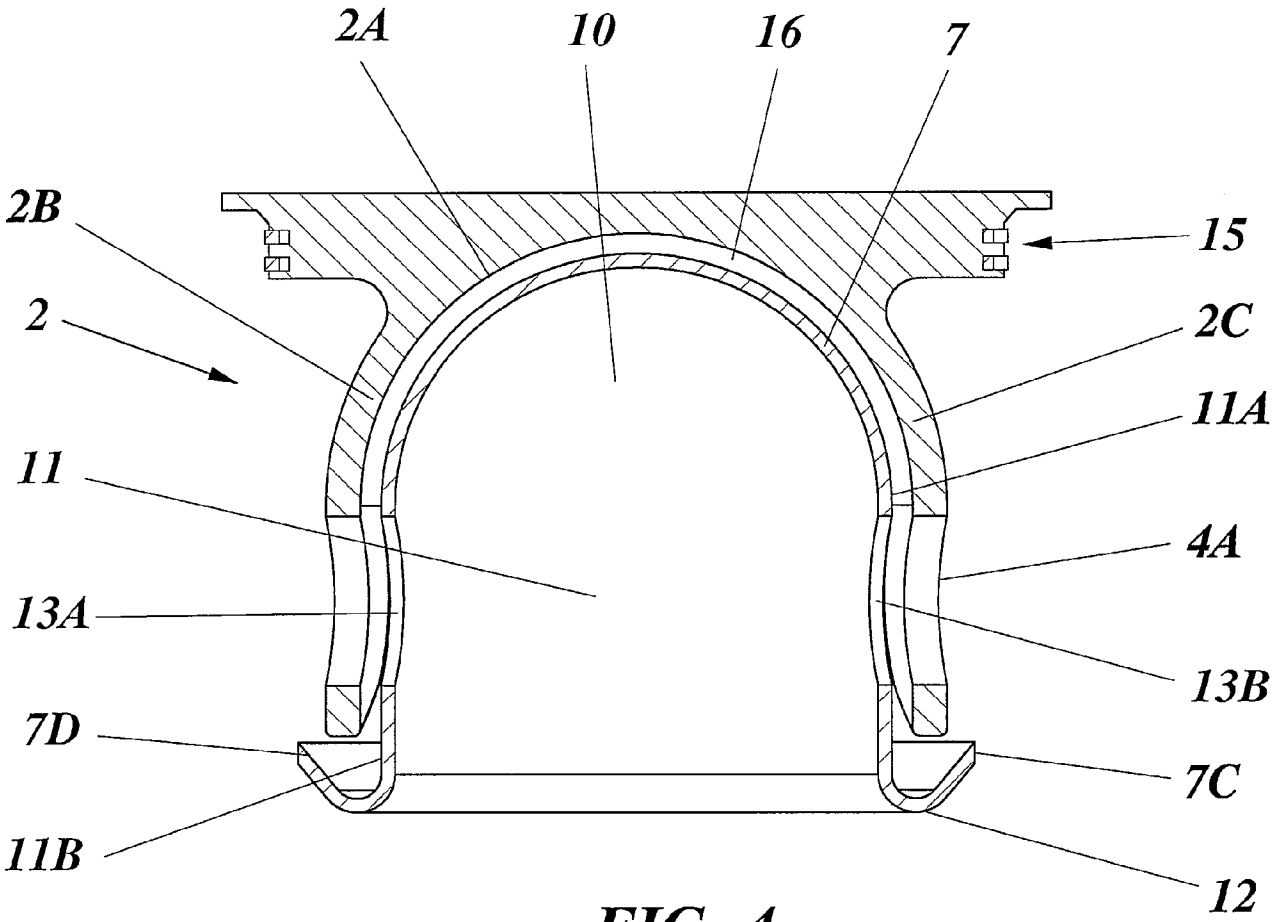
FIG. 4 is a longitudinal section along a plane B-B likewise designated in FIG. 3 and being perpendicular to FIG. 2, through the piston shown in FIG. 1, and with the piston skirt and piston pin removed.
Figure 5:
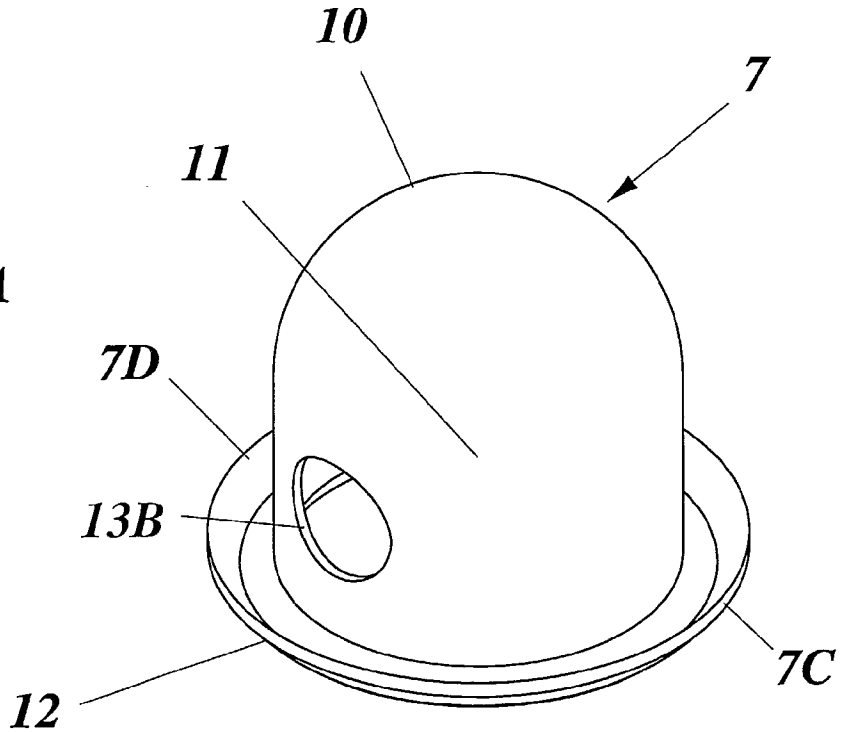
FIG. 5 is a perspective view of the protection being provided in the piston according to the invention.
Figure 6:
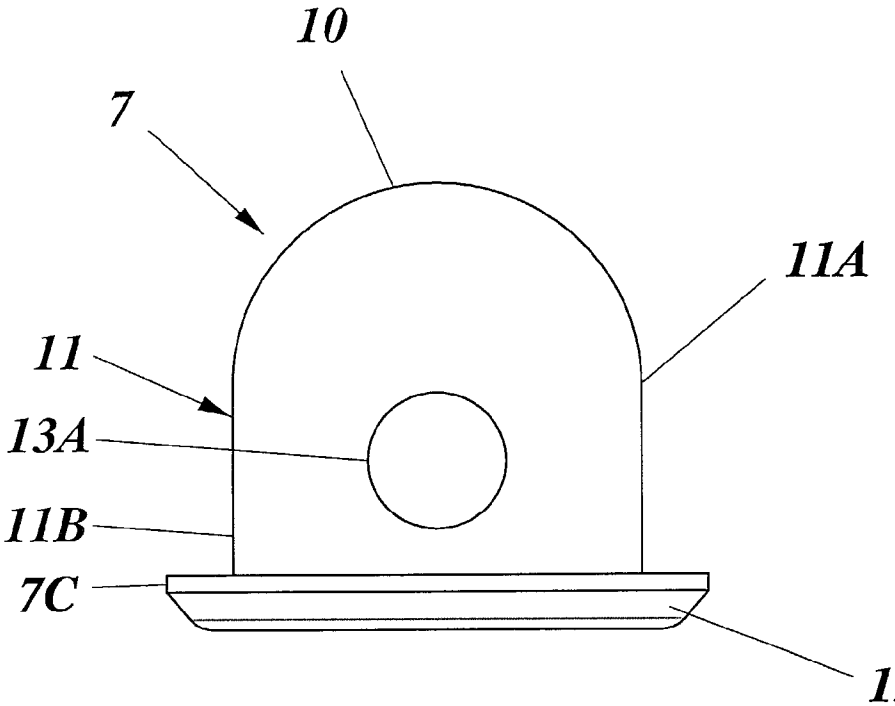
FIG. 6 is a plan view from one side of the protection of FIG. 5.

The piston crown 2 has a general disc shape with a preferably partially curved bottom side 2A and with downwardly, from the disc shape extended support portions 2B, 2C, provided diametrically opposite each other (see FIGS. 1 and 4). In the support portions 2B, 2C is formed a piston pin 5 journal portion 4A that is also in this case formed as apertures therein that are provided diametrically opposite each other.

The piston 1 according to the invention is further provided with a protection or guard 7 that is supported on the piston pin 5 and that covers at least a main portion of the lower or bottom side 2A of the piston crown 2. The purpose of the protection 7 is to protect the piston 1, and more specifically the bottom side 2A of the piston crown 2, from "coking", i.e. that oil burns there. Such coking may even lead to the clogging of oil channels so that oil does not reach the places where it shall serve its purpose. In the worst case such clogging may result in that an engine seizes up or jams. The protection or guard 7 consists of a generally cup or hat shaped hood having an upper dome shaped top portion 10 with a curvature that is preferably adapted to the curvature of the bottom side 2A of the piston crown 2. Furthermore the protection 7 has an essentially cylindrical side wall 11 and an annular, downwardly opening rim 12. All said portions of the protection 7 are preferably made integral with each other. The side wall 11 is provided with a journal portion 13 for the piston pin 5, said journal portion being an integral part of the side wall 11 and in this case also basically being formed by apertures 13A, 13B in the side wall 11, being formed diametrically opposite each other.

The protection 7 consists of a material having restricted thermal conductivity and may suitably be formed of a fiber composite that preferably contains carbon fiber. Alternatively the protection 7 may also be formed in one piece from aluminum. Parts of the protection 7 are furthermore adapted to the shape of the piston crown 2. Mounted on the piston pin 5 the protection thus forms an at least substantially uninterrupted or continuous gap 16 in relation to at least a main portion of the bottom side 2A of the piston crown 2, i.e. the hottest surface of the piston 1. Heat transfer between the material of the piston crown 2 and of the protection 7 may thereby be avoided or at least be greatly reduced. Although the gap 16 between the protection 7 and the piston crown 2 is shown in the drawing figures as having a certain width, it will be appreciated that depending upon the application this gap 16 may be formed having primarily a larger, or a smaller width than the one shown. A broader gap may e.g. be used at very high working temperatures, in order to effectively prevent heat transfer from the piston crown 2 to the protection 7. A narrower gap may be considered when a restricted space is available in the piston.

When such a protection is fitted the working temperature of the piston 1 may be raised, which provides improved combustion and lower fuel consumption. With the protection 7 in position oil in the engine does furthermore not have to cool the hottest part of the piston 1, i.e. the piston crown 2, since the protection 7 covers this part. In this way the engine oil may preserve its quality during extended operating hours.

The protection 7 is mounted on the piston pin 5 by means of the journal portion 13 that in assembled condition sealingly joins the piston pin 5 so that also this and its portions that are journalled in the actual piston 1 are protected from being affected by hot oil. Parts of the protection 7 are also adapted to the shape of the piston skirt 3 so that in the assembled condition it sealingly engages the first inner portion 3A of the piston skirt 3. The purpose thereof is to seal against this inner portion 3A of the piston skirt 3 with high precision so that hot oil cannot enter the gap 16 between the protection 7 and the lower or bottom side 2A of the piston crown 2. Furthermore, at least a portion, preferably a main portion, of the protection 7 is provided at a suitable distance inside the second outer portion 3B of the piston skirt 3 to thereby assist in guiding oil from the engine into the recess 3C and further on to the oil channels 8 for lubricating the oil ring 9.

In the illustrated configuration the protection 7 specifically has a closed top portion 10 that in the assembled condition faces the piston crown 2 and that continues into a first end 11A of the generally cylindrical side wall 11 that at its second end 11B continues into the downwardly opening rim 12 that faces away from the bottom side 2A of the piston crown 2. In association with the rim 12 the protection 7 has an essentially circular largest outer circumference 7C. Immediately adjacent thereto is provided an engagement surface 7D that faces obliquely upward towards the piston crown 2. This engagement surface 7D is intended to sealingly engage, with high precision, a surface at a lower terminal edge of the first inner portion 3A of the piston skirt 3. In the area of the largest outer circumference 7C the protection 7 has an outer diameter D2 that is clearly smaller than an inner diameter D1 of the second outer portion 3B of the piston skirt 3, whereby said open oil communication to the recess 3C and to the oil channels 8 is secured.

In alternative, but not specifically illustrated embodiments of the invention variants or modifications of the different disclosed parts thereof may be used without departing from the scope of the invention. Above all, the invention is not limited to the illustrated and described, schematical design of a two-part piston. Although it may presently be assumed that the invention will have its major area of application in engines that are intended to operate at elevated or higher temperatures and that are for that reason designed having separate piston crown and piston skirt, the invention in its broadest scope covers also variants and modifications of such a piston where its characterizing features provide the same basic functions and advantages as those described above.

Although the invention has been described and illustrated with specific reference to an application intended specifically for four-stroke engines for heavy vehicles, the invention shall in no way be restricted to such specific applications. The basic principles of the invention may thus be applied to other types of engines and for other types of vehicles.

The invention has been described in connection with an embodiment that is presently considered to be most practical and appropriate but it shall be understood that the invention is not limited to the disclosed embodiment. The invention is therefore intended to cover various modifications and equivalent arrangements included within the spirit and scope of the appended claims.

The invention claimed is:

1. A piston of a combustion engine, comprising:

a piston crown and a piston skirt having portions adapted to receive a piston pin by which the piston is pivotally supportable on a connecting rod;

wherein the piston pin supports a protection, such that the protection does not contact the piston crown, the protection having a closed top portion that faces the piston crown, continues into a first end of a side wall, and covers at least a main portion of a bottom side of the piston crown;

wherein the protection is fitted in sealing engagement with an inner portion of the piston skirt, such that oil cannot enter a gap that in assembled condition is delimited by at least the main portion of the bottom side of the piston crown, the protection, and the piston skirt; and wherein at least a portion of the protection is provided at a distance inside an outer portion of the piston skirt that is provided at a distance outside the inner portion of the piston skirt.

2. The piston according to claim 1, wherein the protection has a circular outer circumference immediately adjacent to which is provided an engagement surface that faces towards the piston crown for sealingly engaging the inner portion of the piston skirt.

3. The piston according to claim 2, wherein the protection has a largest outer circumference with an outer diameter that is smaller than an inner diameter of the outer portion of the piston skirt.

4. The piston according to claim 1, wherein between the inner and the outer portions of the piston skirt is formed an annular open recess that faces away from the piston crown and that communicates with oil channels for supplying oil to at least one piston ring.

5. The piston according to claim 1, wherein the protection has a journal portion that in fitted condition sealingly engages the piston pin.

6. The piston according to claim 1, wherein the protection at a second end of the side wall continues into an open rim that faces away from the piston crown.

7. The piston according to claim 5, wherein the journal portion of the protection is formed of apertures in diametrically opposite portions of the side wall and is an integrated part thereof.

8. The piston according to claim 1, wherein the protection is fabricated from a material having limited heat transfer capacity.

9. A protection for the piston according to claim 1, the protection comprising:

a cup-shaped hood having a closed top portion;

a cylindrical side wall;

an annular rim; and a journal portion for a piston pin, whereby the journal portion is integrated in the side wall and consists of apertures formed diametrically opposite each other in the side wall;

wherein the hood, the side wall, and the rim are of an integral, one-piece construction.

10. The protection according to claim 9, wherein the protection is fabricated from a fiber composite that contains carbon fiber.

11. A piston of a combustion engine, comprising:

a piston crown fabricated from a first material;

a piston skirt fabricated from a second material that is different than the first material, the piston skirt connected to the piston crown, the piston skirt having an inner portion and an outer portion that are spaced apart to define a recess with an opening that faces away from the piston crown;

a protection mounted on the inner portion of the piston skirt, the protection covering a surface of the piston crown, such that a sealed gap is provided between the protection and the piston crown; and a piston pin extending through the piston skirt, the piston crown, the protection, and the sealed gap provided between the protection and the piston crown.

* * * * *